United States Patent [19]

Hassler et al.

[11] 4,032,301

[45] June 28, 1977

[54] COMPOSITE METAL AS A CONTACT MATERIAL FOR VACUUM SWITCHES

[75] Inventors: Heinrich Hassler, Wendelstein; Horst Kippenberg, Nurnberg-Weiherhaus; Horst Schreiner, Nurnberg, all of Germany

[73] Assignee: Siemens Aktiengesellschaft, Munich, Germany

[22] Filed: May 6, 1976

[21] Appl. No.: 683,690

Related U.S. Application Data

[63] Continuation-in-part of Ser. No. 503,461, Sept. 5, 1974.

[52] U.S. Cl. ..... 428/567; 75/221; 75/226; 200/264; 200/265; 428/929

[51] Int. Cl.[2] ..... B22F 3/00

[58] Field of Search ..... 29/182, 182.1, 182.2, 29/182.3, 182.5; 75/200, 226, 221; 200/264, 265

[56] References Cited

UNITED STATES PATENTS

| | | | |
|---|---|---|---|
| 2,179,960 | 11/1939 | Schwarzkopf | 75/200 |
| 2,401,221 | 5/1946 | Bourne | 29/182.2 |
| 2,656,595 | 10/1953 | Stern | 29/182.2 |
| 3,366,463 | 1/1968 | Schreiner | 29/182.2 |
| 3,489,530 | 1/1970 | Schreiner | 29/182.1 |
| 3,721,550 | 3/1973 | Schreiner | 75/200 |
| 3,859,087 | 1/1975 | Backstrom | 29/182 |

FOREIGN PATENTS OR APPLICATIONS

| | | |
|---|---|---|
| 1,063,247 | 9/1958 | Germany |

*Primary Examiner*—Brooks H. Hunt
*Attorney, Agent, or Firm*—Kenyon & Kenyon, Reilly, Carr & Chapin

[57] ABSTRACT

A contact material for vacuum switches comprising a composite inclusion metal of at least two metal components in which a first component has an electric conductivity of at least 10 m/ohm mm$^2$, the share of this component being between 35 and 60% by volume. At least one component has a melting point of at least 1400° C and at least one component is effective as a getter. These components are embedded in the first component, with only isolated bridges existing between the finely distributed inclusions. The porosity of the composite inclusion metal is less than 2% by volume.

11 Claims, 3 Drawing Figures

COMPOSITE METAL AS A CONTACT MATERIAL FOR VACUUM SWITCHES

This is a continuation of application Ser. No. 503,461 filed Sept. 5, 1974.

BACKGROUND OF THE INVENTION

This invention is concerned with a composite metal as a contact material for vacuum switches, which exhibit a heterogeneous microstructure and consists of at least two metal components.

In medium-voltage vacuum switches, pure alloys with a copper base or impregnated sintered materials are used as contact materials. These impregnated sintered materials consist of a porous, sintered matrix of a metal with a high melting point, which is impregnated with a metal or a metal alloy with a lower melting point and higher electric conductivity, so that a so-called composite penetration metal is produced. According to the accepted views (Electrical Times, 9, July 1970, "Vacuum Interrupters, Development and Applications", page 48), the contact materials used must have a low gas content and, in particular, an oxygen contant of less than 1 ppm, so that upon melting or evaporation under the action of an arc no excessive pressure increase is produced in the switching tube. To meet these requirements, all heat treatment processes of the contact materials such as alloying, sintering or impregnating are performed in a high vacuum or in a reducing atmosphere with subsequent heat treatment in a high vacuum.

In spite of these precautionary measures, it is as a rule not possible to achieve an impregnation free of voids and pores with impregnated sintered material particularly with matrix metals having oxygen affinity such as silicon, mentioned in German Offenlegungsschrift No. 1,640,038 or chromium, mentioned in German Auslegeschrift No. 1,640,039. The reason for this is, that although with a highly porous matrix metal a decomposition of the oxide coating can be achieved without extreme requirements as to the purity of the protective gas, at high temperatures in a reducing atmosphere, these purity requirements are raised during the cooling phase so much that they cannot be met and unavoidable reoxidation occurs. In the instant impregnation process, the presence of oxide residues must therefore be expected. Because of the high impregnating temperatures, they are partially broken down as diffusion in the pores of the matrix metal filled with the impregnation metal is greatly inhibited. The oxide residue is partly separated off by the liquid impregnating metal and is taken along in the form of slag. With further penetration of the impregnating metal this leads ultimately to the formation of agglomerates in the matrix metal, so that entire pore areas of the matrix metal clog up due to oxide slag residue and are no longer accessible to impregnation. Composite penetration metals made in this manner therefore always contain, in addition to properly penetrated or impregnated areas, void and pore areas which contain oxide slag. The functional reliability of a vacuum switch, however, is greatly reduced by such accumulations of oxide residue, as fairly large amounts of gas, which can result in re-firing of the switch, are liberated through dissociation if the art starts at such oxide residues.

Matrix metals such as tungsten, molybdenum, iron, cobalt and nickel, which are perfectly penetrated by impregnating metals such as, for instance, copper, are applicable, only to a limited extent for other reasons. Tungsten and molybdenum are not suited as matrix metals for interrupting currents above 10kA, which is caused essentially by the substantial electron emission that sets in. Iron, cobalt and nickel, on the other hand, exhibit considerable solubility for impregnating metals such as, for instance, copper, which results in a large drop of the conductivity of the contact material, so that the continuous current must be limited to undesirably low values in order to avoid excessive heating of the contacts.

With contact materials of copper alloys, which were previously mentioned, the difficulties with oxide residues remaining in the material do not exist, because the slag separates on the liquid melt and can readily be removed. Because of their large melting areas, such contact materials, however, tend to have an unfavorable burn-off behavior with interrupting power. Furthermore, due to the essentially homogeneous structure of these contact materials, a desired narrow statistical distribution of the breakoff current is not achieved, or is achieved only through such easily evaporating alloy additions which, because of thier high vapor pressure, reduce the switching capacity in an unpermissible manner.

These statements explain why an optimal contact material for vacuum power switches, which meets the requirements of an oxygen content of less than 1 ppm, freedom from voids, low arc-breaking current with a narrow distribution curve, low weldability and a minimum conductivity of 5 m/ohm mm$^2$ required for reasons of heating, has not yet been found to date.

SUMMARY OF THE INVENTION

It is therefore an object of the invention to provide a contact material for vacuum switches, which can be manufactured economically without particular effort and meets the requirements listed, but in which instead of the oxygen contact of less than 1 ppm, which cannot be realized or only realized with difficulty, an excessive pressure increase in the switching tube under the action of the arc is prevented by other means.

According to the invention, this problem is solved by the provision that the composite metal is a composite inclusion metal, in which a first component has an electric conductivity of at least 10 m/ohm mm$^2$, the amount of this first component being between 35 and 60% by volume; that at least one component has a melting point of at least 1400°C and that furthermore, at least one component is effective as a getter; that the other components are embedded in the first component, only isolated bridges being formed between the finely distributed inclusions, and the porosity of the composite inclusion metal being less than 2% by volume.

Composite inclusion metals have been used as contact materials, but they have not been employed to date in vacuum switches, since part of the operation required for their manufacture takes place under atmospheric conditions and degassing which according to the requirements demanded heretofore is not possible. The instant invention is based on the discovery that in contact materials a gas content of more than 1000 ppm, which is extremely high as compared to the present requirement, can be allowed if at least one component of the contact material is effective as a getter. The term "effective as a getter" is understood here to mean that gases liberated by the action of the arc are bound by chemical absorption (chemisorption) in such a manner that not later than 30 ms after the extinction of the arc the highest partial pressure of a gas in the switching tube is below $10^{-4}$ Torr. A composite inclusion material can therefore also be used as a contact material for vacuum switches, if at least one component is effective as a getter and other requirements are met. The first component must occupy a share of between 35 and 60% by volume, and preferably 50% by volume, of the material, so that a form-locking embedment of the other components and the desired heterogeneous microstructure are achieved. The first component must, furthermore, have an electric conductivity of at least 10 m/ohm mm$^2$, so that in the presence of poorly conducting components a conductivity of the contact material of at least 5 m/ohm mm$^2$ exists. In order to obtain low welding forces, high wear resistance and a favorable burn-off behavior, at least one component must have a melting point of at least 1400° C. The requirement of a porosity of less than 2% by volume ensures that, in order to achieve good dielectric strength of the vacuum switch, the contacts can be electro-polished or chemically surface-treated without acid or electrolyte residue penetrating into the interior of the contact material. The properties required of the individual components of the composite inclusion metal according to the invention can be distributed over two components and be fulfilled also by three or more components simultaneously. However, the composite inclusion metal consists preferably of two or three components, so that the variants I to III listed in the following table are obtained.

| Variant | Number of Components | Conductivity 10 m/ohm$^2$mm | Melting point 1400° C | Effective as getter |
|---|---|---|---|---|
| I | 3 | 1st Comp. | 2nd Comp. | 3rd Comp. |
| II | 2 | 1st Comp. | 2nd Comp. | 2nd Comp. |
| III | 2 | 1st Comp. | 1st Comp. | 2nd Comp. |

As compared to the known composite penetration metals, the use of the composite inclusion metal according to the invention has a number of advantages as a contact material for vacuum switches, which result in part from the different preparation and in part from the different microstructure. In the preparation of the composite inclusion metal, no operations in a high vacuum are required, which particularly makes economical manufacture possible. Furthermore, the melting point of the lowest-melting component need not be exceeded in the manufacture, so that a formation of voids occurs and also no formation of solid-solution crystals which reduce the electric conductivity, even if the individual components are mutually soluble. As no porous matrix is formed in a composite inclusion metal, one can start in the preparation with a very fine-grained metal powder, so that a finely structured texture with optimum burn-off behavior is obtained. Because of the absence of a matrix, forming and the reduction of the degree of porosity are also facilitated.

The linear dimensions of the phase areas of the heterogeneous microstructure is preferably between 10 to 250 um, whereby a particularly low break-off current with a low and narrow break-off distribution is obtained. The first, second and, if applicable, third component, metals are advantageously provided having boiling points, referred to a pressure and 760 Torr, always above 2000° C, so that the quenching capacity and the current interrupting capacity of the vacuum switch are not affected by high vapor pressures.

In a composite inclusion metal with two components, where the first and the second component have little or no mutual solubility and form no intermetallic compounds, which is for instance, the case with copper as the first component and chromium as the second component, the melting point of the lowest-melting component can be exceeded in the preparation. In that case, solid solution crystals which would reduce the electric conductivity form only to a slight extent, in spite of the liquid phase of one component.

In another embodiment of the invention, a method for the preparation of a composite metal is provided comprising mixing the first, second, and if applicable, the third component in powder form, cold pressing the so-formed mixture to form a molding with a porosity of less than 30% by volume, sintering the molding at a temperature below the melting point of the lowest-melting component in a protective gas or in vacuum; and hot-densifying the molding at a temperature below the melting point of the lowest-melting component down to a residual porosity of less than 2% by volume. A contact material prepared by this method develops no liquid phase in any operation, so that no intermetallic compounds or solid solutions are formed even in the case of mutually soluble components. In contrast to the contact materials prepared by sintering and impregnating techniques, the electric conductivity is therefore reduced only to a slight extent by the instant process. For the hot-densification of the sintered molding, the known methods of drop forging, hot re-pressing or extrusion can be used. The attainable filling factor in hot-densification of a sintered molding depends essentially on the pore content, the forming temperature and the densification energy supplied to the molding. This means that a molding, which due to its relatively low permissible sintering temperature still has a relatively high pore content of about 10 to 30% by volume, can be densified by an appropriately increased supply of densification energy to a desirable filling factor of more than 98% by volume. In the case of hot re-pressing or extrusion pressing, this is done through suitable choice of the operating point in the force-vs-elongation diagram, while with drop forging, the impact energy and the number of blows are apportioned accordingly. If required, the forging can take place in several heats instead of one, interposing intermediate anneals, i.e., the molding is heated several times during the forging.

A method for the preparation of a composite metal according to the invention, in which the first and the second component have little or no mutual solubility and form no intermetallic compounds, is provided comprising mixing the first and the second component in powder form, cold-depressing the mixture to form a molding with a porosity below 30% by volume, sintering the molding in protective gas or in vacuum, the sintering temperature being chosen above the melting point ($T_S$) of the first component and at most ($T_S$ + 100° C); and hot-densifying the molding at a temperature below the melting point of the first component to a residual porosity of less than 2% by volume. Since the first and the second component may be only slightly mutually soluble, the first component can form a liquid phase in sintering without reduction of the electric conductivity of the contact material through the formation of solid solution crystals. The sintering temperature should exceed the melting point of the first compound by not more than 100° C, so that the mutual solubility of the components, which increases with temperature, can still be neglected. Sintering in the liquid phase of the first component has the advantage that the porosity of the molding can be reduced to less than 10% by volume. In the subsequent hot-densification, step only a relatively small amount of energy needs to be supplied in order to achieve a residual porosity of less than 2% by volume.

After hot-densification, the molding is preferably annealed in a protective gas or in vacuum. The annealing decomposes the structure stresses built up in the hot-densification, particularly in order to improve the electric conductivity. Through annealing in a vacuum, a removal of the gases which are not chemically bound in the contact material is further achieved.

BRIEF DESCRIPTION OF THE DRAWINGS

In the following, typical forms of the microstructure of a known composite penetration metal and of composite inclusion metals according to the invention will be explained in further detail.

DETAILED DESCRIPTION OF THE DRAWINGS

Figure 1:
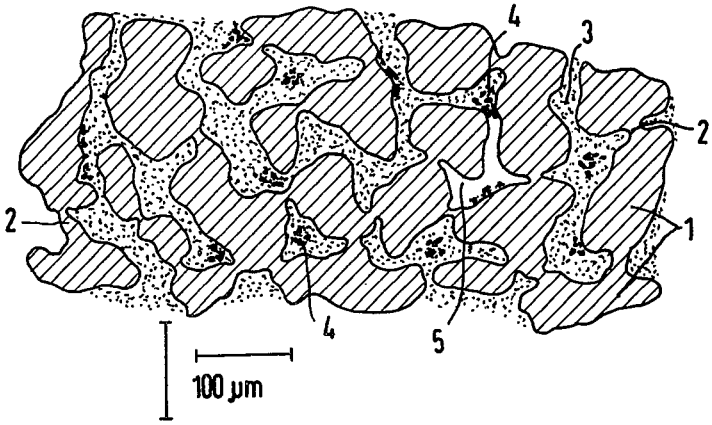
FIG. 1, shows the microstructure of a known composite penetration metal with chromium as the matrix metal and copper as the impregnating metal.

FIG. 1, shows a typical microstructure of a known composite penetration metal with chromium as the matrix metal and copper as the impregnating metal. The scale shows the dimension of 100 um. Chromium particles 1, shown shaded, are connected with each other by sintered bridges 2, so that they form a porous matrix. The voids and pores of the matrix are filled with copper 3. Built into the copper 3, is also oxide slag residue 4, which in some places clogs up entire pore areas 5 and makes them inaccessible for impregnation with the copper 3. When the matrix is impregnated with liquid copper 3, small parts of the chromium particles 1 are dissolved in the copper 3, so that the individual particles exhibit a rounded form. The chromium dissolved in the copper 3 is precipitated again upon cooling down.

Figure 2:
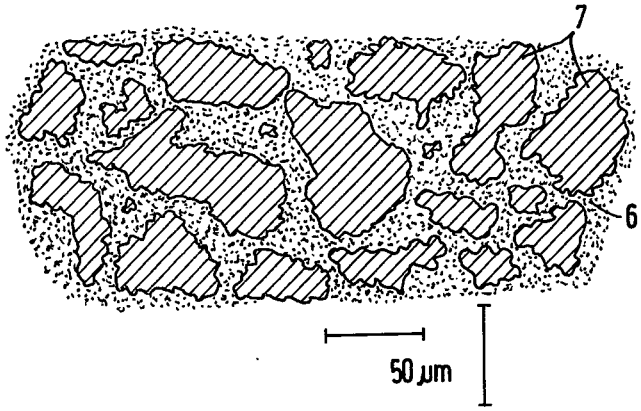
FIG. 2, shows the microstructure of a composite inclusion metal according to the invention, not sintered in the liquid phase, with chromium embedded in copper.

FIG. 2 shows a typical microstructure of a composite inclusion metal according to the invention, not sintered in the liquid phase, with chromium embedded in copper. The scale shows the order of magnitude of 50 um. In a phase of copper 6, which flows more easily in the forming process, chromium particles 7 are firmly embedded, with only isolated bridge formations existing between the particles. In the preparation of the composite inclusion metal, the melting temperature of the copper 6 is not reached or exceeded in any operation, so that no chromium is dissolved in the copper 6 and the individual chromium particles still have their original, bizarre shape.

Figure 3:
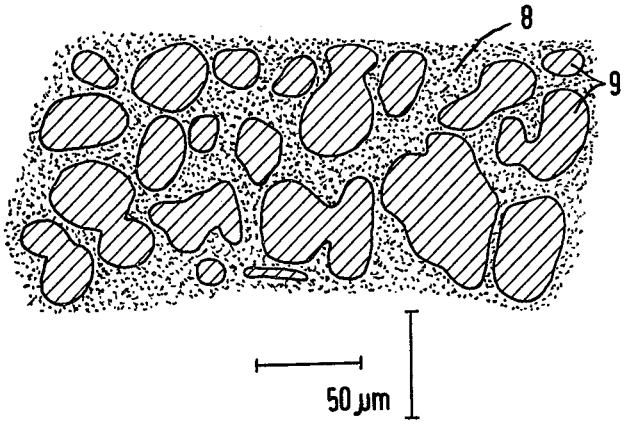
FIG. 3, shows the microstructure of a composite inclusion metal according to the invention, sintered in the liquid phase, with chromium embedded in copper.

FIG. 3 shows a typical microstructure of a composite inclusion metal according to the invention, sintered in the liquid phase, with chromium embedded in copper. As in FIG. 2, chromium particles 9 are firmly embedded in a phase of copper 8, which flows more easily in the forming process, with only isolated bridge formations existing between the particles. In the sintering of the composite inclusion metal, the melting point of the copper 8 is exceeded, so that a liquid copper phase is formed. Small amounts of the chromium particles 9 dissolve in this liquid copper phase, so that the individual particles exhibit a rounded shape. Upon cooling down, the chromium in the copper 8 is precipitated again.

The invention will be illustrated further in the following examples.

EXAMPLE 1

A mixture of 50% by weight of copper powder with a particle diameter of 50 um and smaller, 25% by weight of iron powder with a grain size of less than 150 um and 25% by weight of chromium powder with a grain size of less than 25 $\mu$m is pressed in wet condition at a pressure of $30 \times 10^4$ N/cm$^2$. After heating-up in an $H_2$-atmosphere, the molding prepared in this manner is sintered for 1 hour at 1000° C and hot-forged at 1000° C. Finally, the mixture was vacuum annealed for 1hour at 500° C.

EXAMPLE 2

Copper powder and chromium powder with a grain size of less than 75 um were mixed in the weight ratio of 1:1 and coldpressed at a pressure of $25 \times 10^4$ N/cm$^2$. The molding made in this manner is sintered at 1000° C after having been heated up for 1 hour in an $H_2$-atmosphere. Subsequently, the sintered molding is hot-forged at a temperature of 1000° C. A vacuum anneal of 1 hour at 500° C completed the operation.

EXAMPLE 3

Copper powder and chromium powder with a grain size of less than 75 um were mixed in a weight ratio of 1:1 and cold-pressed at a pressure of $25 \times 10^4$ N/cm$^2$. The molding made in this manner is sintered in a vacuum for 1 hour at 1100° C, after heating up in an $H_2$-atmosphere. As the sintering temperature exceeds the melting point of copper, the sintering takes place in the liquid phase. Subsequently, the sintered molding is hot-forged at a temperature at 1000° C. Vacuum annealing for 1hour at 500° C completed the operation.

EXAMPLE 4

A mixture of 60% by weight of nickel powder with a grain size of less than 50 um and 40% by weight of chromium powder also with a grain size of less than 50 um is cold-pressed at a pressure of $35 \times 10^4$ N/cm$^2$. The molding made in this manner is subsequently sintered at 1300° C in a protective gas. Thereupon the sintered molding is drop-forged at 1200° C. A vacuum annealing for 1 hour at 600° C completed the operation.

EXAMPLE 5

A mixture of 20% by weight of titanium powder, 30% by weight of nickel powder and 50% of copper powder with particle sizes of less than 150 um is pressed at a pressure of $25 \times 10^4$ N/cm$^2$ to form a molding and is sintered for 1 hour and 30 minutes at 850° C in a protective gas. Subsequently the molding is forged in several heats, the forging temperature being 850° C. A vacuum annealing treatment of 1 hour at a temperature of 500° C completed the operation.

EXAMPLE 6

A mixture of 60% by weight of copper powder, 15% by weight of zirconium powder and 25% by weight of iron powder with particle sizes of less than 100 um is pressed at a pressure of $30 \times 10^4$ N/cm$^2$ to form a molding and then sintered for 1 hour in vacuum at 850° C. The densification of the sintered molding is accomplished by hot repressing at 850° C and a pressure of $50\times 10^4$ N/cm$^2$. Subsequently a soluton annealing of 1 hour in vacuum took place at a temperature of 400° C.

What is claimed is:

1. A composite inclusion metal for vacuum switches comprising a mixture of copper as a first metal component in an amount from about 35% to 60% by volume of said composite inclusion metal, a second metal component selected from the group consisting of iron and nickel and a getter component selected from the group consisting of chromium, titanium and zirconium; wherein at least one of said second or getter components is embedded in said copper to form a heterogeneous microstructure with only isolated bridge formations existing between finely-distributed inclusions, said composite inclusion metal being formed by cold-pressing a mixture of said copper, said second metal component and said getter component to form a molding with a porosity of less than 30% by volume, sintering the molding at a temperature below the melting point of the lowest melting component of said mixture in a protective gas or vacuum, and hot-densifying the molding at a temperature below the melting point of the lowest melting component down to a residual porosity of less than 2% by volume.

2. The composite metal of claim 1, wherein the linear extent of the phase areas of the heterogeneous microstructure is between 10 and 250 um.

3. The composite metal of claim 1, wherein the share of the first component is 50% by volume.

4. A composite inclusion metal for vacuum switches comprising a mixture of copper or nickel as a first component in an amount of from 35 to 60% by volume of said composite, a second metal component consisting of aluminum wherein said second component is embedded in said first component to form a heterogeneous microstructure with only isolated bridge formations existing between finely-distributed inclusions, said composite inclusion metal being formed by cold-pressing a mixture of said components to form a molding with a porosity of less than 30% by volume, sintering the molding at a temperature below the melting point of the lowest-melting component of said mixture in a protective gas or vacuum and hot densifying the molding at a temperature below the melting point of the lowest-melting component down to a residual porosity of less than 2% by volume.

5. The composite metal of claim 4, wherein the first component is copper or nickel and the second component is aluminum.

6. The composite metal of claim 4, wherein the first component is copper and the second component is nickel.

7. The composite inclusion metal of claim 4 which further comprises annealing the molding after the hot-densification step.

8. The composite inclusion metal of claim 4 wherein the linear extent of the phase areas of the heterogeneous microstructure is between 10 and 250 um.

9. The composite inclusion metal of claim 4, wherein the first component is present in an amount of about 50% by volume of the composite.

10. A composite inclusion metal of a mixture of copper and chromium wherein said copper is present in an amount of from 35 to 60% by volume, said chromium being embedded in said copper to form a heterogeneous microstructure with only isolated bridge formations existing between finely-distributed inclusions, said composite inclusion metal being prepared by mixing the copper and chromium in powder form, cold-pressing the mixture to form a molding with a porosity of less than 30% by volume, sintering the molding in a protective gas or vacuum, the sintering temperature being in the range of from above the melting temperature of said copper to a temperature not exceeding 100° C above said melting temperature, and hot densifying the molding at a temperature below the melting point of the copper down to a residual porosity of less than 2% by volume.

11. The composite inclusion metal method of claim 10 which further comprises annealing the molding after the hot-densification step.

* * * * *